United States Patent [19]

Faragher, Jr.

[11] 4,126,172

[45] Nov. 21, 1978

[54] SHOWER CURTAIN

[75] Inventor: Raymond F. Faragher, Jr., Kenton Hills, Ky.

[73] Assignee: Saturday Knight Ltd., Cincinnati, Ohio

[21] Appl. No.: 836,579

[22] Filed: Sep. 26, 1977

[51] Int. Cl.[2] ..... A47H 1/00

[52] U.S. Cl. ..... 160/126; 4/149; 160/124; 160/330

[58] Field of Search ..... 160/126, 123, 124, 237, 160/330, 120; 4/149, 153, 154

[56] References Cited

U.S. PATENT DOCUMENTS

| | | | |
|---|---|---|---|
| 909,004 | 1/1909 | Luft | 160/126 |
| 1,017,765 | 2/1912 | Kiefer | 160/126 |
| 2,450,782 | 10/1948 | Cascia | 160/237 X |
| 2,840,155 | 6/1958 | Stern | 160/124 |
| 3,308,872 | 3/1967 | Smith | 160/120 |

*Primary Examiner*—Philip C. Kannan

*Attorney, Agent, or Firm*—Wood, Herron & Evans

[57] ABSTRACT

An improved shower curtain structure having an inner curtain and an outer curtain. The inner curtain is opaque and establishes an aesthetic background on the outer face thereof. The outer curtain is at least partially transparent with that portion of the outer curtain that is not transparent establishing a pattern thereon. The inner curtain's background and the outer curtain's pattern cooperate to define an illustration having a three-dimensional effect on a viewer positioned exteriorly of the bathtub or shower stall when the curtains are extended into generally parallel and spaced relation one with another.

3 Claims, 2 Drawing Figures

SHOWER CURTAIN

Figure 2:
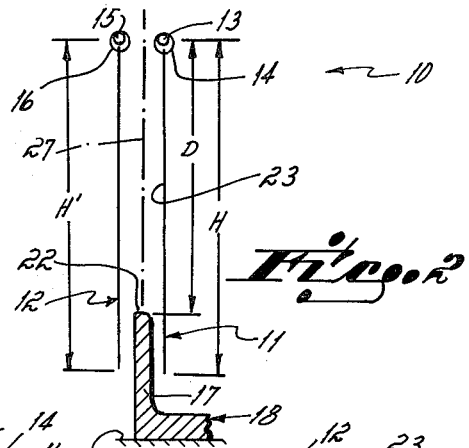

This invention relates to shower curtains. More particularly, this invention relates to an improved shower curtain structure.

Shower curtains have been known to the prior art for years and years. The primary objective of a shower curtain is, of course, to prevent a shower head's water spray from being splashed all over the bathroom floor when the user is taking a shower in a bathtube or shower stall in that bathroom.

One very old and very well known shower curtain structure includes a single opaque shower curtain adapted to hang vertically from a horizontal rod disposed above the edge of a bathtub or the floor of a shower stall. This single shower curtain is water repellent, and on the outer face thereof is provided with an aesthetic background which may or may not include patterns or illustrations. Another well known shower curtain structure, which has seen increasing use in recent years, includes an inner shower curtain and an outer shower curtain, both curtains being hung from a single shower curtain rod. In this shower curtain struture, the inner curtain is generally water repellent, and the outer face of the outer curtain is generally provided with a decorative or aesthetic design or background. In this dual curtain structure, the inner water repellent curtain may be replaced periodically without replacing the outer decorative curtain.

It has been a primary objective of this invention to provide an improved shower curtain structure having an inner curtain and an outer curtain in which the two curtains cooperate one with another to provide an aesthetic design to a viewer positioned outside the shower head area when the shower curtain is in use.

It has been another objective of this invention to provide an improved shower curtain structure that includes an inner curtain which is opaque, and an outer curtain that is at least partially transparent, the outer curtain having a decorative pattern thereon adapted to cooperate with an aesthetic background on the outer face of the inner curtain to provide an illustration having a three-dimensional effect to a viewer positioned outside the shower area when the shower curtain is extended into its use position.

In accord with these objectives, the improved shower curtain structure of this invention includes an inner curtain and an outer curtain. The inner curtain is opaque and establishes an aesthetic background on the outer face thereof. The outer curtain is at least partially transparent with that portion of the outer curtain that is not transparent establishing a pattern thereon. The inner curtain's background and the outer curtain's pattern cooperate to define an illustration having a three-dimensional effect on a viewer positioned exteriorly of the bathtub or shower stall when the curtains are extended into generally parallel and spaced relation one with another.

Figure 1:
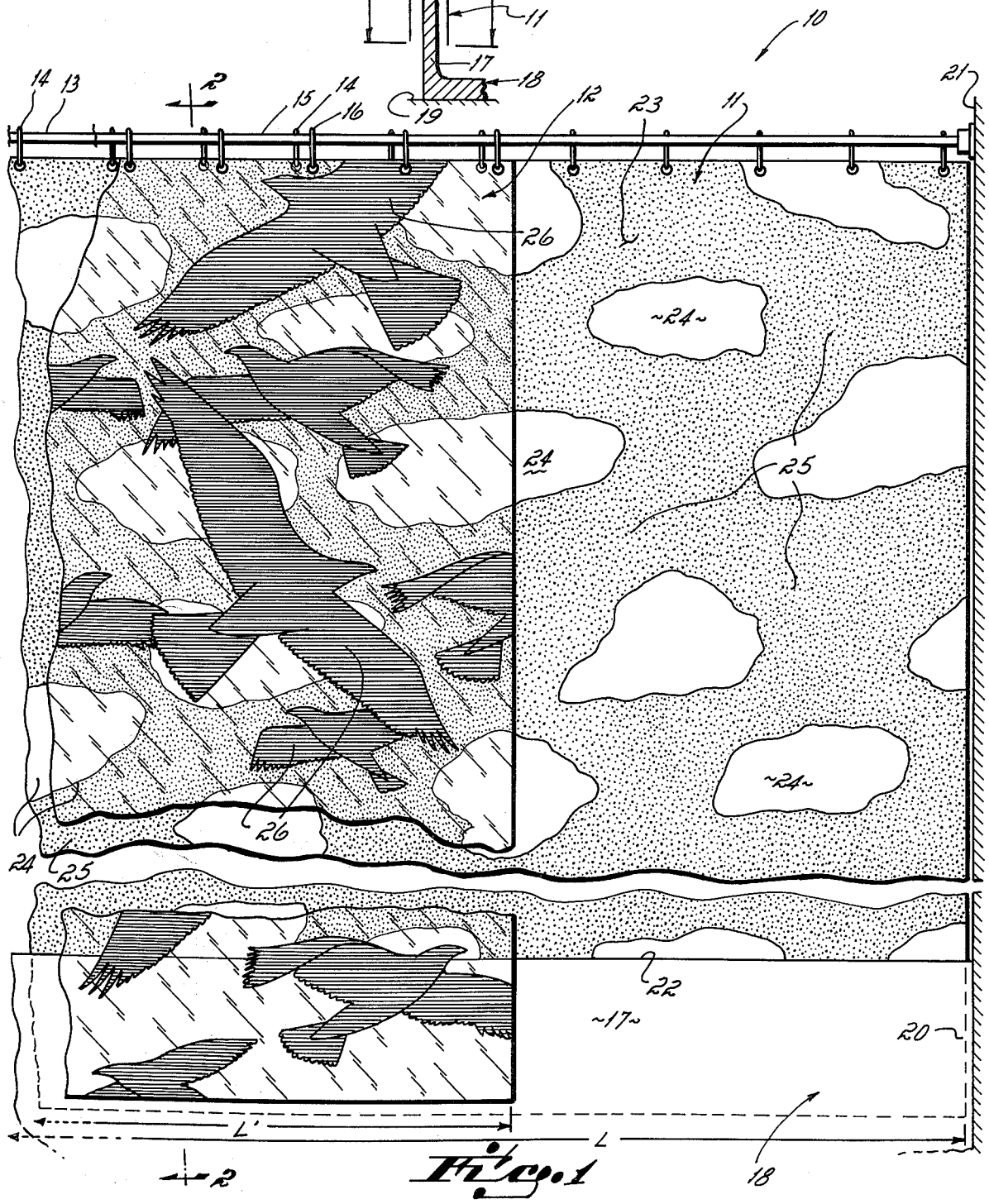

Other objectives and advantages of this invention will be apparent from the following detailed description taken in conjunction with the drawings in which:

FIG. 1 is a side elevational view illustrating a shower curtain structure in accord with the principles of this invention, the shower curtain structure being shown in operative combination with the side wall of a bathtub, and being shown in a use position; and FIG. 2 is a cross-sectional view taken along line 2—2 of FIG. 1.

As illustrated in the figures, the improved shower curtain structure 10 of this invention includes an inner curtain 11 and an outer curtain 12. The inner curtain 11 is hung from curtain rod 13 by rings 14, and the outer curtain 12 is hung from curtain rod 15 by rings 16. Both curtain rods 13, 15 are located substantially above the side wall 17 of bathtub 18 and parallel to floor 19, and both curtain rods extend parallel one to another and parallel to that side wall from one end 20 of the bathtub to the other (not shown). Note particularly that the curtain rods 13, 15 are spaced one from the other a distance greater than the width of the bathtub's side wall 17, see FIG. 2. The curtain rods 13, 15 are fixed to wall 21 of the bathroom in known fashion, and of course, the bathtub is fixed to bathroom floor 19 and abuts the wall 21 also in known fashion. Note each of the inner 11 and outer 12 curtains is a height H greater than the distance D between the bathrub side wall's top edge 22 and the shower curtain rods 13, 15, thereby permitting the curtains to extend down beyond the top edge of that bathtub side wall when in the use attitude illustrated in the FIGS. It will be understood that this shower curtain structure 10 may be also used with a shower stall, not shown.

The inner shower curtain 11 is opaque, and is fabricated of a water repellent material. The inner shower curtain is preferably opaque throughout the heigh H and length L thereof, i.e., is opaque throughout its entire surface area. Importantly, the inner curtain 11 is provided, on the outer face 23 thereof, with an aesthetic background. The aesthetic background may be in the nature of a single color on the outer face 23 of that inner curtain 11. However, and instead of a single color background, it is preferred that the background be provided with a pattern adapted to cooperate with the outer shower curtain 12, as more particularly described below, so as to provide an overall three-dimensional effect for the shower curtain structure 10. In this regard, and as shown in FIG. 2, a plurality of randomly cloud shaped areas 24, which are white, are located on blue outer face 23, thereby simulating clouds 24 in a blue sky 25.

The outer shower curtain 12 is at least partially transparent with that portion of the outer curtain not transparent establishing a pattern thereon. The outer curtain's pattern cooperates with the inner curtain's background so that the inner 11 and outer 12 shower curtain structures, when viewed by a viewer located exteriorly of the bathtub 18, and when the shower curtains are extended or lengthened into the use or shower position illustrated in FIG. 2, cooperate to present a three-dimensional illustration to the viewer. More particularly, and as shown in FIG. 1, the outer shower curtain 12 is completely transparent throughout the height H inch and length L inch thereof, i.e., is transparent throughout its entire surface area, except in certain pattern areas 26 which are opaque. The pattern areas 26 are preferably configured to cooperate aesthetically with the background on outer face 23 of the inner curtain 11. In the embodiment shown, the opaque pattern areas 26 are configured in the shape of flying birds. Thus, and when the curtain 11, 12 are extended into the use or shower attitude shown in FIG. 2, a three-dimensional effect is provided of birds 26 flying against cloud 24 filled sky 25. This three-dimensional effect presented by the inner 11 and outer 12 shower curtains is desirable in that it provides a pleasing atmosphere to that room within which the bathtub 18 or shower stall (not shown) is located.

As particularly shown in FIG. 2, and as noted above, the inner shower curtain 11 is hung on one rod 13 and the outer shower curtain 12 is hung on another rod 15, the inner rod being disposed on the inside of a phantom vertical plane 27 that includes the side wall 17 of the bathtub 18, and the outer rod being disposed on the outside of that same phantom vertical plane. Thus, the inner 11 and outer 12 shower curtains are maintained in a preset spaced relation one which another so as to produce the desired three-dimensional effect when the curtains are pulled into the use position. It is possible, however, to hang both inner 11 and outer 12 shower curtains, fabricated in accord with the principles of this invention, on a single curtain rod (not shown) where that curtain rod is disposed generally in the phantom vertical plane 27 that includes the side wall 17 of bathtub 18. This is not as desirable as the preferred dual rod 13, 15 embodiment shown because the three-dimensional effect established between the inner 11 and outer 12 shower curtains, when those curtains are extended into the use or shower-taking attitude shown in FIG. 1, is not as great as the visual three-dimensional effect provided if the inner and outer shower curtain are hung on separate rods as shown in the figures Having described in detail the preferred embodiment of my invention, what I desire to claim and protect by Letters Patent is:

1. A three-dimensional shower curtain structure comprising the combination of:

an opaque inner shower curtain having an inner side and an outer side, and a pattern on said outer side;

an outer shower curtain having transparent portions and pattern portions;

said curtains being mounted in relation to a tub such that said inner curtain is hung above said tub, a lower portion thereof extending into said tub proximate one side of a tub sidewall, and such that said outer curtain is hung substantially parallel to said inner curtain and has a lower portion proximate an opposite side of said tube sidewall;

at least said lower portions of said inner and outer curtains being spaced apart a distance at least equal to said tub sidewall;

said pattern on said inner curtain being visible through said transparent portions of said outer curtain; and said pattern on said inner curtain and said pattern portions on said outer curtain cooperating together to produce a three-dimensional effect.

2. An improved shower curtain structure as set forth in claim 4 in which the pattern area of said outer curtain is opaque.

3. An improved shower curtain structure as set forth in claim 1 including a first curtain rod on which said inner curtain rod is hung and a second curtain rod on which said outer curtain is hung, said curtain rods being spaced from one another and parallel to one another.

* * * * *

UNITED STATES PATENT AND TRADEMARK OFFICE

CERTIFICATE OF CORRECTION

PATENT NO. : 4,126,172

DATED : November 21, 1978

INVENTOR(S) : Raymond F. Faragher, Jr.

It is certified that error appears in the above-identified patent and that said Letters Patent are hereby corrected as shown below:

| | | | |
|---|---|---|---|
| Col. 1 | Line 11 | "bathtube" | should be --bathtub-- |
| Col. 2 | Line 19 | "is a height" | should be --is of a height-- |
| Col. 2 | Line 20 | "bathrub" | should be --bathtub-- |
| Col. 2 | Line 29 | "heigh" | should be --height-- |
| Col. 3 | Line 12 | "which" | should be --with-- |
| Col. 3 | Line 27 | "curtain" | should be --curtains-- |
| Col. 3 | Line 28 | after figures | "." |
| Col. 4 | Line 13 | "tube" | should be --tub-- |
| Col. 4 | Line 24 | "4" | should be --1-- |

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*